United States Patent [19]

Clearman et al.

[11] Patent Number: 4,756,318

[45] Date of Patent: Jul. 12, 1988

[54] SMOKING ARTICLE WITH TOBACCO JACKET

[75] Inventors: Jack F. Clearman, Blakely, Ga.; Thomas L. Gentry, Winston-Salem; Gary R. Shelar, Greensboro, both of N.C.

[73] Assignee: R. J. Reynolds Tobacco Company, Winston-Salem, N.C.

[21] Appl. No.: 791,721

[22] Filed: Oct. 28, 1985

[51] Int. Cl.[4] ..... A24D 1/18; A24D 1/00; A24D 1/02

[52] U.S. Cl. ..... 131/359; 131/273; 131/335; 131/196; 131/360

[58] Field of Search ..... 131/364, 362, 360, 194, 131/273, 356, 337, 335, 329

[56] References Cited

U.S. PATENT DOCUMENTS

| | | |
|---|---|---|
| Re. 27,214 | 11/1971 | Nakahara . |
| 2,907,686 | 10/1959 | Siegel . |
| 3,258,015 | 6/1966 | Ellis . |
| 3,356,094 | 12/1957 | Ellis . |
| 3,516,417 | 6/1970 | Moses . |
| 3,540,456 | 11/1970 | McGlumphy et al. ..... 131/337 |
| 3,614,956 | 10/1971 | Thornton . |
| 3,738,374 | 6/1973 | Bennett . |
| 3,943,941 | 3/1976 | Boyd . |
| 4,044,777 | 8/1977 | Boyd . |
| 4,079,742 | 3/1978 | Ranier . |
| 4,219,031 | 8/1980 | Ranier . |
| 4,284,089 | 8/1981 | Ray . |
| 4,286,604 | 9/1981 | Ehretsman . |
| 4,326,544 | 4/1982 | Hardwick . |
| 4,340,072 | 7/1982 | Bolt . |
| 4,347,855 | 9/1982 | Lanzillotti . |
| 4,391,285 | 7/1983 | Burnett . |
| 4,474,191 | 10/1984 | Steiner . |

FOREIGN PATENT DOCUMENTS

| | | |
|---|---|---|
| 276250 | 7/1965 | Australia . |
| 117355 | 8/1984 | European Pat. Off. . |
| 1294351 | 5/1964 | Fed. Rep. of Germany . |
| 8684/k967 | of 0000 | Japan . |
| 13985/3890 | 9/1985 | Liberia . |
| 1185887 | 3/1970 | United Kingdom . |
| 1431045 | 4/1972 | United Kingdom . |

OTHER PUBLICATIONS

Guinness World Book of Records, p. 242–243 (1985 Edition).

Guinness World Book of Records, p. 194 (1966 Edition).

Tobacco Substitutes, Noyes Data Corporation (1976).

*Primary Examiner*—V. Millin

*Attorney, Agent, or Firm*—Grover M. Myers; David G. Conlin

[57] ABSTRACT

The present invention preferably relates to a smoking article which is capable of producing substantial quantities of aerosol, both initially and over the useful life of the product, without significant thermal degradation of the aerosol former and without the presence of substantial pyrolysis or incomplete combustion products or sidestream aerosol.

Preferred embodiments of the present smoking article comprise a short combustible carbonaceous fuel element, a physically separate aerosol generating means including an aerosol forming substance, a physically separate tobacco jacket around at least the aerosol generating means, and a relatively long mouth end piece.

The articles of the present invention provide the user with taste, feel and aroma, associated with the smoking of conventional cigarettes. Tobacco in many embodiments of this invention is burned to provide a sidestream aroma and smoke. In other embodiments, tobacco does not burn, but still provides tobacco flavors to the aerosol delivered to the user.

33 Claims, 2 Drawing Sheets

SMOKING ARTICLE WITH TOBACCO JACKET

BACKGROUND OF THE INVENTION

The present invention relates to a smoking article which preferably produces an aerosol that resembles tobacco smoke and which preferably contains no more than a minimal amount of incomplete combustion or pyrolysis products.

Many smoking articles have been proposed through the years, especially over the last 20 to 30 years. But none of these products has ever realized any commercial success.

Tobacco substitutes have been made from a wide variety of treated and untreated plant material, such as cornstalks, eucalyptus leaves, lettuce leaves, corn leaves, cornsilk, alfalfa, and the like. Numerous patents teach proposed tobacco substitutes made by modifying cellulosic materials, such as by oxidation, by heat treatment, or by the addition of materials to modify the properties of cellulose. One of the most complete lists of these substitutes is found in U.S. Pat. No. 4,079,742 to Rainer et al. Despite these extensive efforts, it is believed that none of these products has been found to be satisfactory as a tobacco substitute.

Many proposed smoking articles have been based on the generation of an aerosol or a vapor. Some of these products purportedly produce an aerosol or a vapor without heat. See, e.g., U.S. Pat. No. 4,284,089 to Ray. However, the aerosols or vapors from these articles fail to adequately simulate tobacco smoke.

Some proposed aerosol generating smoking articles have used a heat or fuel source in order to produce an aerosol. However, none of these articles has ever achieved any commercial success, and it is believed that none has ever been widely marketed. The absence of such smoking articles from the marketplace is believed to be due to a variety of reasons, including insufficient aerosol generation, both initially and over the life of the product, poor taste, off-taste due to the thermal degradation of the smoke former and/or flavor agents, the presence of substantial pyrolysis products and sidestream smoke, and unsightly appearance.

One of the earliest of these proposed articles was described by Siegel in U.S. Pat. No. 2,907,686. Siegel proposed a cigarette substitute which included an absorbent carbon fuel, preferably a 2½ inch (63.5 mm ) stick of charcoal, which was burnable to produce hot gases, and a flavoring agent carried by the fuel, which was adapted to be distilled off incident to the production of the hot gases. Siegel also proposed that a separate carrier could be used for the flavoring agent, such as a clay, and that a smoke-forming agent, such as glycerol, could be admixed with the flavoring agent. Siegel's proposed cigarette substitute would be coated with a concentrated sugar solution to provide an impervious coat and to force the hot gases and flavoring agents to flow toward the mouth of the user. It is believed that the presence of the flavoring and/or smoke-forming agents in the fuel of Siegel's article would cause substantial thermal degradation of those agents and an attendant off-taste. Moreover, it is believed that the article would tend to produce substantial sidestream smoke containing the aforementioned unpleasant thermal degradation products.

Another such article was described by Ellis et al. in U.S. Pat. No. 3,258,015. Ellis et al. proposed a smoking article which had an outer cylinder of fuel having good smoldering characteristics, preferably fine cut tobacco or reconstituted tobacco, surrounding a metal tube containing tobacco, reconstituted tobacco, or other source of nicotine and water vapor. On smoking, the burning fuel heated the nicotine source material to cause the release of nicotine vapor and potentially aerosol generating material, including water vapor. This was mixed with heated air which entered the open end of the tube. A substantial disadvantage of this article was the ultimate protrusion of the metal tube as the tobacco fuel was consumed. Other apparent disadvantages of this proposed smoking article include the presence of substantial tobacco pyrolysis products, the substantial tobacco sidestream smoke and ash, and the possible pyrolysis of the nicotine source material in the metal tube.

In U.S. Pat. No. 3,356,094, Ellis et al. modified their original design to eliminate the protruding metal tube. This new design employed a tube made out of a material, such as certain inorganic salts or an epoxy bonded ceramic, which became frangible upon heating. This frangible tube was then removed when the smoker eliminated ash from the end of the article. Even though the appearance of the article was very similar to a conventional cigarette, apparently no commercial product was ever marketed. See also, British Pat. No. 1,185,887 which discloses similar articles.

In U.S. Pat. No. 3,738,374, Bennett proposed the use of carbon or graphite fibers, mat, or cloth associated with an oxidizing agent as a substitute cigarette filler. Flavor was provided by the incorporation of a flavor or fragrance into the mouthend of an optional filter tip.

U.S. Pat. Nos. 3,943,941 and 4,044,777 to Boyd et al. and British pat. No. 1,431,045 proposed the use of a fibrous carbon fuel which was mixed or impregnated with volatile solids or liquids which were capable of distilling or subliming into the smoke stream to provide "smoke" to be inhaled upon burning of the fuel. Among the enumerated smoke producing agents were polyhydric alcohols, such as propylene glycol, glycerol, and 1,3-butylene glycol, and glyceryl esters, such as triacetin. Despite Boyd et al.'s desire that the volatile materials distill without chemical change, it is believed that the mixture of these materials with the fuel would lead to substantial thermal decomposition of the volatile materials and to bitter off tastes. Similar products were proposed in U.S. Pat. No. 4,286,604 to Ehretsmann et al. and in U.S. Pat. No, 4,326,544 to Hardwick et al.

Bolt et al., in U.S. Pat. No. 4,340,072 proposed a smoking article having a fuel rod with a central air passageway and a mouthend chamber containing an aerosol forming material. The fuel rod preferably was a molding or extrusion of reconstituted tobacco and/or tobacco substitute, although the patent also proposed the use of tobacco, a mixture of tobacco substitute material and carbon, or a sodium carboxymethylcellulose (SCMC) and carbon mixture. The aerosol forming material was proposed to be a nicotine source material, or granules or microcapsules of a flavorant in triacetin or benzyl benzoate. Upon burning, air entered the air passage where it was mixed with combustion gases from the burning rod. The flow of these hot gases reportedly ruptured the granules or microcapsules to release the volatile material. This material reportedly formed an aerosol and/or was transferred into the mainstream aerosol. It is believed that the articles of Bolt et al., due in part to the long fuel rod, would produce insufficient aerosol from the aerosol former to be acceptable, especially in the early puffs. The use of microcapsules or granules would further impair aerosol delivery because of the heat needed to rupture the wall material. Moreover, total aerosol delivery would appear dependent on the use of tobacco or tobacco substitute materials, which would provide substantial pyrolysis products and sidestream smoke which would not be desirable in this type smoking article.

U.S. Pat. No. 3,516,417 to Moses proposed a smoking article, with a tobacco fuel, which was identical to the article of Bolt et al., except that Moses used a double density plug of tobacco in lieu of the granular or microencapsulated flavorant of Bolt et al. See FIG. 4, and col. 4, lines, 17–35. Similar tobacco fuel articles are described in U.S. Pat. No. 4,347,855 to Lanzillotti et al. and in U.S. Pat. No. 4,391,285 to Burnett et al. European Patent Appln. No. 117,355 (Hearn) describes similar smoking articles having a pyrolyzed ligno-cellulosic heat source, having an axial passageway therein. These articles would suffer many of the same problems as the articles proposed by Bolt et al.

Steiner, in U.S. Pat. No. 4,474,191 describes "smoking devices" containing an air-intake channel which, except during the lighting of the device, is completely isolated from the combustion chamber by a fire resistant wall. To assist in the lighting of the device, Steiner provides means for allowing the brief, temporary passage of air between the combustion chamber and the air-intake channel. Steiner's heat conductive wall also serves as a deposition area for nicotine and other volatile or sublimable tobacco simulating substances. In one embodiment (FIGS. 9 & 10), the device is provided with a hard, heat transmitting envelope. Materials reported to be useful for this envelope include ceramics, graphite, metals, etc. In another embodiment, Steiner envisions the replacement of his tobacco (or other combustible material) fuel source with some purified cellulose-based product in an open cell configuration, mixed with activated charcoal. This material, when impregnated with an aromatic substance is stated to dispense a smoke-free, tobacco-like aroma.

Thus, despite decades of interest and effort, there is still no smoking article on the market which provides the benefits and advantages associated with conventional cigarette smoking, without delivering considerable quantities of incomplete combustion and pyrolysis products.

SUMMARY OF THE INVENTION

The present invention relates to a smoking article which is capable of producing substantial quantities of aerosol, both initially and over the useful life of the product, preferably without significant thermal degradation of the aerosol former and without the presence of substantial pyrolysis or incomplete combustion products.

These and other advantages are obtained by providing an elongated, cigarette-type smoking article which generally utilizes a short, i.e., less than about 30 mm long, preferably carbonaceous, fuel element, a physically separate aerosol generating means including an aerosol forming substance, and a physically separate mass or jacket of tobacco containing material which encircles at least a portion of the aerosol generating means and through which gases and/or the aerosol forming substance may pass during smoking of the article to contribute volatile tobacco flavors to the aerosol.

The placement of a tobacco containing mass around the periphery of the aerosol generating means in close proximity to the fuel element but physically separate from it, helps to maximize heat transfer to the tobacco and the release of volatile tobacco flavors from the tobacco. This peripheral tobacco jacket also helps provide the user with the aroma and feel of a conventional cigarette.

Preferably, the aerosol generating means and the fuel element are in a conductive heat exchange relationship, and/or the aerosol forming substance is located within a heat conductive container which may be provided with passages through which gases and vapors pass to the peripheral tobacco jacket. Preferred embodiments of this type are particularly advantageous because they provide conductive heat transfer to the tobacco mass and a means of controlling gas flow through the tobacco.

Preferably, at least a portion of the fuel element is provided with a peripheral insulating jacket to reduce radial heat loss. Alternatively, the fuel element may be encircled by a mass or jacket of tobacco containing material, which further simulates the appearance, feel, and aroma of a conventional cigarette, by one or more layers of cigarette paper, or by no peripheral wrap at all. In embodiments where the fuel element is encircled by a tobacco containing material, the tobacco around the fuel element normally burns which provides sidestream smoke and aroma as well as contributing tobacco flavors to the aerosol. Embodiments of this type are preferably designed so that the tobacco around the aerosol generating means does not burn, thereby reducing the production of tobacco combustion products. Various methods for preventing the burning of this tobacco are discussed in detail infra.

The fuel elements useful in practicing this invention are preferably less than about 20 mm in length, more preferably less than about 15 mm in length, from 2 to 8 mm in diameter, and have a density of at least about 0.5 g/cc. Preferred fuel elements are normally provided with one or more longitudinal passageways, preferably from 5 to 9 passageways, which help to control the transfer of heat from the fuel element to the aerosol forming substance.

The conductive heat exchange relationship between the fuel and the aerosol generating means is preferably achieved by providing a heat conducting member, such as a metal conductor, which contacts at least a portion of the fuel element and the aerosol generating means, and preferably forms the conductive container for the aerosol forming materials. Preferably, the heat conducting member is recessed from the lighting end of the fuel element, advantageously by at least about 3 mm or more, preferably by at least about 5 mm or more, to avoid interfering with the lighting and/or burning of the fuel element and to avoid any protrusion of the member after the fuel element has ceased burning.

In addition, at least a part of the fuel element is preferably provided with a peripheral insulating member, such as a jacket of insulating fibers which reduces radial heat loss and assists in retaining and directing heat from the fuel element toward the aerosol generating means and may aid in reducing any fire causing property of the fuel element. Preferably the jacket is resilient and at least 0.5 mm thick, Preferred smoking articles of the type described herein are particularly advantageous because the hot, burning fire cone is always close to the aerosol generating means, which maximizes heat transfer thereto and maximizes the resultant production of aerosol, especially in embodiments which are provided with a multiple passageway fuel element, a heat conducting member, and/or an insulating member. In addition, because the aerosol forming substance is physically separate from the fuel element, it is exposed to substantially lower temperatures than are present in the burning fire cone, thereby minimizing the possibility of thermal degradation of the aerosol former.

The smoking article of the present invention is normally provided with a mouthend piece including means, such as a longitudinal passageway, for delivering the aerosol produced by the aerosol generating means to the user. Preferably, the mouthend piece includes a resilient outer member, such as an annular section of cellulose acetate tow, to help simulate the feel of a conventional cigarette. Advantageously, the article has the same overall dimensions as a conventional cigarette, and as a result, the mouthend piece and the aerosol delivery means usually extend over about one-half or more of the length of the article. Alternatively, the fuel element and the aerosol generating means may be produced without a built-in mouthend piece or aerosol delivery means, for use with a separate, disposable or reusable mouthend piece, e.g., a cigarette holder.

The aerosol generating means may include an additional charge of tobacco to add additional tobacco flavors to the aerosol. Advantageously, this additional tobacco charge may be placed at the mouthend of the aerosol generating means, or it may be mixed with a carrier for the aerosol forming substance. Other substances, such as flavoring agents, may be incorporated in a similar manner. In some embodiments, a tobacco charge may be used as the carrier for the aerosol forming substance. Tobacco, a tobacco flavor extract, or other flavoring agents may alternatively, or additionally, be incorporated in the fuel element to provide additional tobacco flavor.

Preferred embodiments of this invention are capable of delivering at least 0.6 mg of aerosol, measured as wet total particulate matter (WTPM), in the first 3 puffs, when smoked under FTC smoking conditions, which consist of a 35 ml puff volume of two seconds duration, separated by 58 seconds of smolder. More preferably, embodiments of the invention are capable of delivering 1.5 mg or more of aerosol in the first 3 puffs. Most preferably, embodiments of the invention are capable of delivering 3 mg or more of aerosol in the first 3 puffs when smoked under FTC smoking conditions. Moreover, preferred embodiments of the invention deliver an average of at least about 0.8 mg of WTPM per puff for at least about 6 puffs, preferably at least about 10 puffs, under FTC smoking conditions.

In addition to the aforementioned benefits, preferred smoking articles of the present invention are capable of providing an aerosol which is chemically simple, consisting essentially of air, oxides of carbon, water, the aerosol former, any desired flavors or other desired volatile materials, and trace amounts of other materials. This aerosol has no significant mutagenic activity as measured by the Ames test. In addition, articles of this invention may be made virtually ashless, so that the user does not have to remove any ash during use.

As used herein, and only for the purposes of this application, "aerosol" is defined to include vapors, gases, particles, and the like, both visible and invisible, and especially those components perceived by the user to be "smoke-like" especially those which are generated by action of the heat from the burning fuel element upon substances contained within the aerosol generating means, or elsewhere in the article. As so defined, the term "aerosol" also includes volatile flavoring agents and/or pharmacologically or physiologically active agents, irrespective of whether they produce a visible aerosol.

As used herein, the phrase "conductive heat exchange relationship" is defined as a physical arrangement of the aerosol generating means and the fuel element whereby heat is transferred by conduction from the burning fuel element to the aerosol generating means substantially throughout the burning period of the fuel element. Conductive heat exchange relationships can be achieved by placing the aerosol generating means in contact with the fuel element and thus in close proximity to the burning portion of the fuel element, and/or by utilizing a conductive member to carry heat from the burning fuel to the aerosol generating means. preferably both methods of providing conductive heat transfer are used.

As used herein, the term "carbonaceous" means primarily comprising carbon.

As used herein, the term "insulating member" applies to all materials which act primarily as insulators. Preferably, these materials do not burn during use, but they may include slow burning carbons and like materials, as well as materials which fuse during use, such as low temperature grades of glass fibers. The insulators have a thermal conductivity in g-cal/(sec) ($cm_2$)(°C/cm), of less than about 0.05, preferably less than about 0.02, most preferably less than about 0.005, see, *Hackh's Chemical Dictionary* 34 (4th ed., 1969) and Lange's *Handbook of Chemistry* 10, 272–274 (11th ed., 1973).

The preferred smoking articles of the present invention are described in greater detail in the accompanying drawings and in the detailed description of the invention which follow.

DETAILED DESCRIPTION OF THE PREFERRED EMBODIMENTS

Figure 1:
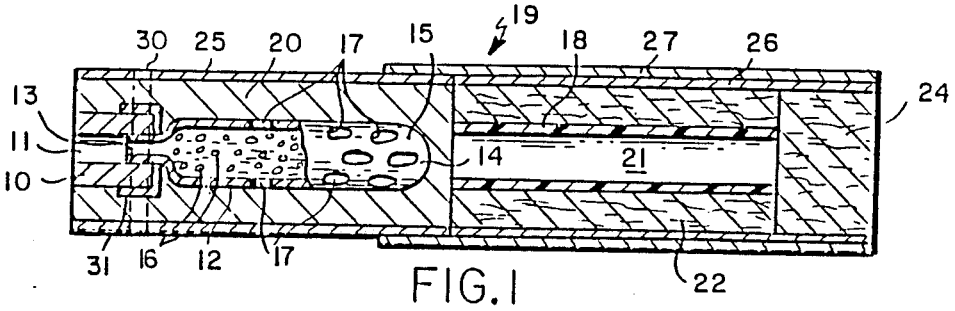
FIGS. 1 through 3 are longitudinal sectional views of various embodiments of the present invention.

The embodiment of the invention illustrated in FIG. 1, has about the same overall dimensions as a conventional cigarette. It includes a short, combustible carbonaceous fuel element 10, a heat conductive container 12 which encloses a substrate bearing an aerosol forming substance, a jacket of tobacco 20 which encircles fuel element 10 and container 12, and a mouthend piece 19.

Figure 1A:
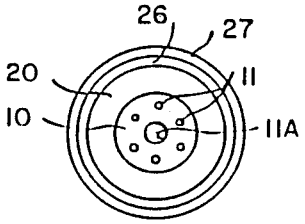
FIGS. 1A, 1B, 2A, 2B, 3B, 3C, and 3D are sectional views of various fuel element passageway configurations useful in the embodiments of the present invention.
Figure 1B:
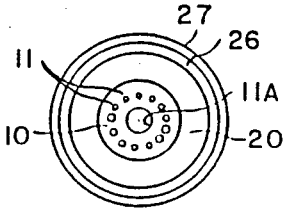

In the embodiment shown in FIG. 1, the extruded carbonaceous fuel element 10 is about 7 to 10 mm long and is provided with seven passageways 11 and 11A. FIGS. 1A and 1B illustrate two of the many different passageway configurations useful in the articles of the present invention. As illustrated, central passageway 11A is larger than peripheral passageways 11.

The aerosol generating means in this embodiment comprises a granular or particulate substrate 16, such as carbon, alumina, and/or densified tobacco, which carry one or more aerosol forming substances. This aerosol generating means is enclosed within a metallic container 12 having a crimped, but open fuel end 13 and a closed mouth end 14. As illustrated, open end 13 of 25 metallic container 12 is inserted into the rear (mouth end) of fuel element passageway 11A. A metallic cap 31 may optionally be provided around the rear portion of the fuel element to help prevent the burning of the tobacco behind the fuel element.

The inserted portion 13 of container 12 occupies about 2 to 3 mm of the mouth end of central passageway 11A in fuel element 10. End 14 of container 12 is totally closed, forming wall 15. A plurality of passageways 17 are located on the periphery of container 12, which permit the passage of air, gases, the aerosol forming substance, and/or tobacco flavors therethrough into the tobacco jacket 20.

Plastic tube 18 abutts the mouth end of tobacco jacket 20 and forms aerosol delivery passageway 21. Plastic tube 18 is surrounded by a section of resilient, high density cellulose acetate tow 22. A filter element 24 is located contiguous to the mouth end of tow 22. As illustrated, the article (or portions thereof) is overwrapped with one or more layers of cigarette paper 25, 26 and 27.

Figure 2:
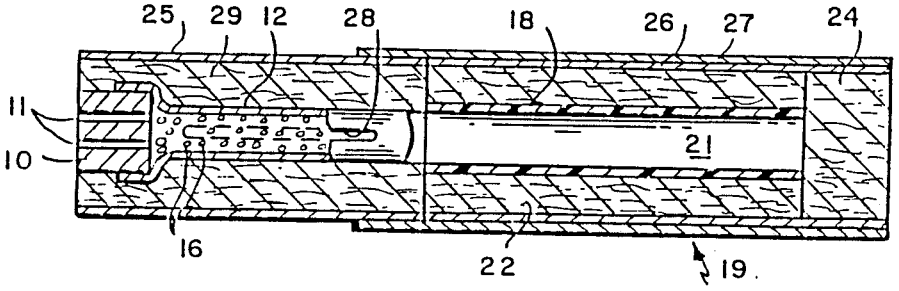

The embodiment illustrated in FIG. 2 is similar to that of FIG. 1. Jacket 29 comprises a tobacco containing mass and the rear portion of the fuel element is inserted about 2 to 3 mm into the mouthend of the capsule. As illustrated, jacket 29 extends just beyond the mouth end of the heat conductive capsule 12 for the aerosol generating means. Container 12 is provided with one or more longitudinal slots 28 on its periphery (preferably two, 180° apart) so that the vapors from the capsule pass through the annular section of tobacco surrounding the capsule extracting tobacco flavors before entering aerosol delivery passage 21.

As illustrated, the tobacco at the fuel element end of the jacket is compressed. This aids in reducing air flow through the tobacco, thereby reducing the burn potential thereof. In addition, the capsule 12 aids in stopping the burning of the tobacco by acting as a heat sink. This heat sink effect helps quench any burning of the tobacco surrounding the capsule, and evenly distributes the heat to the tobacco, thereby aiding in the release of tobacco flavor components therefrom.

Figure 2A:
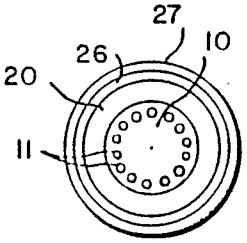
Figure 2B:
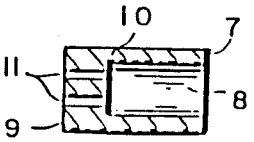

FIG. 2A illustrates one fuel element passageway arrangement useful herein. In this embodiment, the fuel element is provided with a plurality of passageways 11 (preferably about 12) which extend from the lighting end to the mouth end of the fuel element. FIG. 2B illustrates another fuel element passageway arrangement suitable for use in the smoking articles of the present invention. In this embodiment, three or more passageways 11 (preferably seven to nine) begin at lighting end 9 of fuel element 10 and pass only partially there through. At a point within the body of fuel element 10, the passageways 11 merge with a large cavity 8 which extends to the mouth end 7 of fuel element 10.

Figure 3:
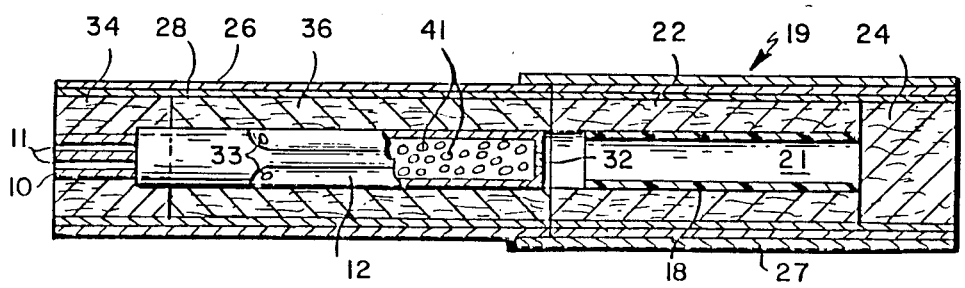
Figure 3A:
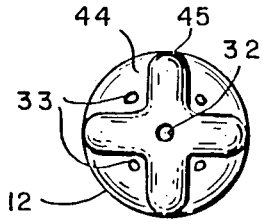
FIG. 3A is an enlarged end view of the metallic capsule used in the article of FIG. 3.

FIG. 3 illustrates another embodiment of the tobacco jacketed smoking article of the present invention. Overlapping the mouth end of fuel element 10 is metallic capsule 12, about 20 to 35 mm in length, which contains a substrate material 41. The periphery of fuel element 10 in this embodiment is surrounded by a jacket 34 of resilient insulating fibers, such as glass fiber, and capsule 12 is surrounded by a jacket of tobacco 36. The rear portion of capsule 12 is crimped as shown in FIG. 3A to provide an alternating series of grooved channels 44 and ribs 45. As illustrated, a passageway 32 is provided at the mouth end of the capsule in the center of the crimped tube. Four additional passageways 33 are provided at the transition points between the crimped and the uncrimped portion of the capsule. Alternatively, the rear portion of the capsule may have a rectangular cross section in lieu of the channels and ribs, or a tubular capsule may be employed with or without peripheral passageways.

At the mouth end of tobacco jacket 36 is situated a mouthend piece 19 comprised of a cellulose acetate cylinder 22, a centrally located plastic tube 18 which provides aerosol passageway 21, and a low efficiency cellulose acetate filter piece 24. As illustrated, the capsule end of plastic tube 18 does not abut the capsule. Thus, vapors flowing through passageways 33 into tobacco jacket 36 flow into passageway 21 where tobacco jacket 36 abuts the cellulose acetate cylinder 22. As illustrated, the article (or portions thereof) is overwrapped with one or more layers of cigarette paper 26, 27 and 28.

In some embodiments of this type having a low density insulating member around the fuel element, some air and gases pass through the fuel element insulating member and into the tobacco jacket. Thus, peripheral passageways in the capsule may not be needed to extract tobacco flavors from the tobacco jacket.

Figure 3B:
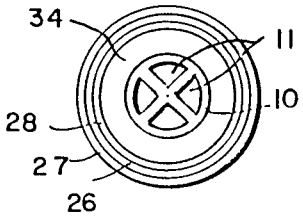
Figure 3C:
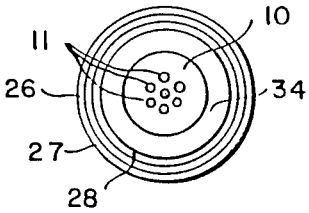
Figure 3D:
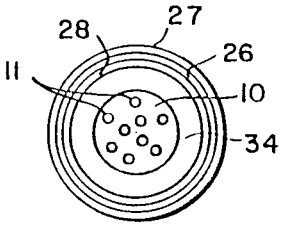

FIG. 3B illustrates one fuel element passageway arrangement useful in the smoking articles of the present invention. As illustrated, an extruded carbonaceous fuel element 10 is employed, with four distinct passageways 11, each having a "wedge shape" or segment arrangement. Another fuel element passageway arrangement is shown at FIG. 3C. As illustrated, fuel element 10 is provided with a plurality of passageways 11, situated near the center of the fuel element so that, during burning, the passageways coalesce into a single passageway, at least at the lighting end of the fuel element. FIG. 3D shows another useful fuel element passageway arrangement in which the element is provided with a plurality of passageways 11.

In embodiments utilizing a tobacco jacket around the fuel element, as in FIGS. 1 and 2, it may be desirable to treat a portion of the cigarette paper overwrap at or near the mouth end of the fuel with a material such as sodium silicate to help prevent burning of the tobacco behind the exposed portion of the fuel element. Such treated portions are illustrated by sodium silicate band 30 in FIG. 1. Alternatively, the tobacco jacket itself may be treated with a burn modifier to prevent burning of the tobacco which surrounds the aerosol generator.

Upon lighting any of the aforesaid embodiments, the fuel element burns, generating the heat used to volatilize the aerosol forming substance or substances in the aerosol generating means. Because the preferred fuel element is relatively short, the hot, burning fire cone is always close to the aerosol generating means which maximizes heat transfer to the aerosol generating means, and resultant production of aerosol, especially when the preferred heat conducting member is used. Because of the small size and burning characteristics of the preferred fuel elements employed in the present invention, the fuel element usually begins to burn over substantially all of its exposed length within a few puffs. Thus, that portion of the fuel element adjacent to the aerosol generator becomes hot quickly, which significantly increases heat transfer to the aerosol generator, especially during the early puffs. Because the preferred fuel element is so short, there is never a long section of nonburning fuel to act as a heat sink, as was common in previous thermal aerosol articles.

Heat transferred from the aerosol generating means to the peripheral tobacco jacket, whether by conduction or convection, heats the tobacco, thus enabling the vapors from the aerosol generator to more easily extract tobacco flavor components from the jacket. These flavor components mix with the aerosol vapors and are delivered to the user as a smoke-like aerosol.

Control of heat transfer to the aerosol generating means is important both in terms of transferring enough heat to produce sufficient aerosol and in terms of avoiding the transfer of so much heat that the aerosol former is degraded. Control of heat transfer is also important to avoid burning of the tobacco jacket which surrounds the aerosol generating means. The degree of heat transferred from the fuel element and/or the aerosol generating means to the tobacco jacket should be sufficient to aid in the release of tobacco flavor components, but should not be so high as to cause pyrolysis or degredation of the tobacco which would contribute undesirable pyrolysis or degradation products to the aerosol delivered to the user.

Heat transfer is enhanced by the heat conductive material employed in the preferred conductive container for the aerosol forming substances, which aids in the distribution of heat to the peripheral tobacco jacket and to the portion of the aerosol forming substance which is physically remote from the fuel. This helps produce good aerosol and a tobacco flavor in the early puffs.

Heat transfer also is enhanced by the use of a heat conducting member, which may form part of the metallic enclosure for the aerosol generating means, which contacts or couples the fuel element and the aerosol generating means. Preferably, this member is recessed, i.e., spaced from, the lighting end of the fuel element, by at least about 3 mm, preferably by at least about 5 mm or more, to avoid interference with the lighting and burning of the fuel element and to avoid any protrusion after the fuel element is consumed.

The control of heat transfer may also be aided by the use of an insulating member as a peripheral overwrap over at least a part of the fuel element. Such an insulating member helps ensure good aerosol production by retaining and directing much of the heat generated by the burning fuel element toward the aerosol generating means.

The control of heat transfer from the fuel element to the aerosol generating means may also be aided by the presence of a plurality of passageways in the fuel element, which allow the rapid passage of hot gases to the aerosol generator, especially during puffing.

Because the aerosol forming substance is physically separate from the fuel element, the aerosol forming substance is exposed to substantially lower temperatures than are generated by the burning fuel, thereby minimizing the possibility of its thermal degradation. This also results in aerosol production almost exclusively during puffing, with little or no aerosol production from the aerosol generating means during smolder.

In the preferred embodiments of the invention, the short carbonaceous fuel element, the fuel insulating jacket, the recessed heat conducting member, and/or the passages in the fuel cooperate with the aerosol generator to provide a system which is capable of producing substantial quantities of tobacco flavored aerosol, on virtually every puff. The close proximity of the fire cone to the aerosol generator after a few puffs, together with the conductive elements of the container, the conducting member, and/or the fuel insulating jacket, result in high heat delivery both during puffing and during the relatively long period of smolder between puffs.

While not wishing to be bound by theory, it is believed that the aerosol generating means is maintained at a relatively high temperature between puffs, and that the additional heat delivered during puffs, which is significantly increased by the preferred passageways in the fuel element, is primarily utilized to vaporize the aerosol forming substance. This increased heat transfer makes more efficient use of the available fuel energy, reduces the amount of fuel needed, and helps deliver early aerosol. Furthermore, the conductive heat transfer utilized in the present invention is believed to reduce the carbon fuel combustion temperature which, it is further believed, reduces the $CO/CO_2$ ratio in the combustion products produced by the fuel. See, e.g., G. Hagg, *General Inorganic Chemistry,* at p. 592 (John Wiley & Sons, 1969).

In general, the combustible fuel elements which may be employed in practicing the invention have a diameter no larger than that of a conventional cigarette (i.e., less than or equal to 8 mm), and are generally less than about 30 mm long. Advantageously the fuel element is about 20 mm or less in length, preferably about 15 mm or less in length. Advantageously, the diameter of the fuel element is between about 3 to 7 mm, preferably about 4 to 5 mm. The density of the fuel elements employed herein may range from about 0.5 g/cc to about 1.5 g/cc as measured, e.g., by mercury displacement. Preferably the density is greater than about 0.7 g/cc, more preferably greater than about 0.8 g/cc.

The preferred fuel elements employed herein are primarily formed of a carbonaceous material. Carbonaceous fuel elements are preferably from about 5 to 15 mm, more preferably, from about 8 to 12 mm in length. Preferably, the density is greater than 0.7 g/cc. Carbonaceous fuel elements having these characteristics are sufficient to provide fuel for at least about 7 to 10 puffs, the normal number of puffs generally obtained by smoking a conventional cigarette under FTC conditions.

Preferably, the carbon content of these fuel elements is at least 60 to 70%, most preferably about 80% or more, by weight. High carbon content fuel elements are preferred because they produce minimal pyrolysis and incomplete combustion products, little or no visible sidestream smoke, and minimal ash, and have high heat capacity. However, lower carbon content fuel elements e.g., about 50 to 60% carbon by weight, are within the scope of this invention, especially where a minor amount of tobacco, tobacco extract, or a nonburning inert filler is used.

Also, while not preferred, other fuel materials may be employed, such as tobacco, tobacco substitutes and the like, provided that they generate and conduct sufficient heat to the aerosol generating means to produce the desired level of aerosol from the aerosol forming material, as discussed above. The density of the fuel used should be above about 0.5 g/cc preferably above about 0.7 g/cc which is higher than the densities normally used in conventional smoking articles. Where such other materials are used,it is much preferred to include carbon in the fuel, preferably in amounts of at least about 20 to 40% by weight, more preferably at least about 50% by weight, and most preferably at least about 65 to 70% by weight, the balance being the other fuel components, including any binder, burn modifiers, moisture, etc.

The carbonaceous materials used in or as the preferred fuel element may be derived from virtually any of the numerous carbon sources known to those skilled in the art. Preferably, the carbonaceous material is obtained by the pyrolysis or carbonization of cellulosic materials, such as wood, cotton, rayon, tobacco, coconut, paper, and the like, although carbonaceous materials from other sources may be used.

In most instances, the carbonaceous fuel elements should be capable of being ignited by a conventional cigarette lighter without the use of an oxidizing agent. Burning characteristics of this type may generally be obtained from a cellulosic material which has been pyrolyzed at temperatures between about 400° C. to about 1000° C., preferably between about 500° C. to about 950° C., most preferably at about 750° C., in an inert atmosphere or under a vacuum. The pyrolysis time is not believed to be critical, as long as the temperature at the center of the pyrolyzed mass has reached the aforesaid temperature range for at least a few, e.g., about 15, minutes. A slow pyrolysis, employing gradually increasing temperatures over many hours, is believed to produce a uniform material with a high carbon yield. Preferably, the pyrolyzed material is then cooled, ground to a fine powder, and heated in an inert gas stream at a temperature between about 650° C. to 750° C. to remove volatiles prior to further processing.

While undesirable in most cases, carbonaceous materials which require the use of an oxidizing agent to render them ignitable by a cigarette lighter are within the scope of this invention, as are carbonaceous materials which require the use of a glow retardant or other type of combustion modifying agent. Such combustion modifying agents are disclosed in many patents and publications and are well known to those of ordinary skill in the art.

In certain preferred embodiments, the carbonaceous fuel elements are substantially free of volatile organic material. By that, it is meant that the fuel element is not purposely impregnated or mixed with substantial amounts of volatile organic materials, such as volatile aerosol forming or flavoring agents, which could degrade in the burning fuel. However, small amounts of materials, e.g., water, which are naturally adsorbed by the carbon in the fuel element, may be present therein. Similarly, small amounts of aerosol forming substances may migrate from the aerosol generating means and thus may also be present in the fuel.

In other preferred embodiments, the fuel element may contain minor amounts of tobacco, tobacco extracts, and/or other materials, primarily to add flavor to the aerosol. Amounts of these additives may range up to about 25 weight percent or more, depending upon the additive, the fuel element, and the desired burning characteristics. Tobacco and/or tobacco extracts may be added to carbonaceous fuel elements at about 10 to 20 weight percent, thereby providing tobacco flavors to the mainstream and tobacco aroma to the sidestream akin to a conventional cigarette, without affecting the Ames test activity of the product.

A preferred carbonaceous fuel element is a pressed or extruded mass of carbon prepared from a powdered carbon and a binder, by conventional pressure forming or extrusion techniques. A preferred activated carbon for such a fuel element is PCB-G, and a preferred nonactivated carbon is PXC, both available from Calgon Carbon Corporation, Pittsburgh, Pa. Other preferred nonactivated carbons for pressure forming are prepared from pyrolized cotton or pyrolized papers, such as Grande Prairie Canadian Kraft, available from the Buckeye Cellulose Corporation of Memphis, TN.

The binders which may be used in preparing such a fuel element are well known in the art. A preferred binder is sodium carboxymethylcellulose (SCMC), which may be used alone, which is preferred, or in conjunction with materials such as sodium chloride, vermiculite, bentonite, calcium carbonate, and the like. Other useful binders include gums, such as guar gum, and other cellulose derivatives, such as methylcellulose and carboxymethylcellulose (CMC).

A wide range of binder concentrations can be utilized. Preferably, the amount of binder is limited to minimize contribution of the binder to undesirable combustion products. On the other hand, sufficient binder must be included to hold the fuel element together during manufacture and use. The amount used will thus depend on the cohesiveness of the carbon in the fuel.

In general, an extruded carbonaceous fuel may be prepared by admixing from about 50 to 99 weight percent, preferably about 80 to 95 weight percent, of the carbonaceous material, with from 1 to 50 weight percent, preferably about 5 to 20 weight percent of the binder, with sufficient water to make a paste having a stiff dough-like consistency. Minor amounts, e.g., up to about 35 weight percent, preferably about 10 to 20 weight percent, of tobacco, tobacco extract, and the like, may be added to the paste with additional water, if necessary, to maintain a stiff dough consistency. The dough is then extruded using a standard ram or piston type extruder into the desired shape, with the desired number and configuration of passageways, and dried, preferably at about 95° C. to reduce the moisture content to about 2 to 7 percent by weight. Alternatively, or additionally, the passageways and/or cavity may be formed using conventional drilling techniques. If desired, the lighting end of the fuel elements may be tapered or reduced in diameter by machining, molding, or the like, to improve lightability.

A high quality fuel element may be formed by casting a thin slurry of the carbon/binder mixture (with or without additional components) into a sheet, drying the sheet, regrinding the dried sheet into a powder, forming a stiff paste with water, and extruding the paste as described above.

If desired, carbon/binder fuel elements (without tobacco, and the like) may be pyrolyzed after formation, for example, to about 650° C. for two hours, to convert the binder to carbon and thereby form a virtually 100% carbon fuel element.

The fuel elements of the present invention also may contain one or more additives to improve burning, such as up to about 5 weight percent of sodium chloride to improve smoldering characteristics and as a glow retardant. Also, up to about 5, preferably from about 1 to 2, weight percent of potassium carbonate may be included to control flammability. Additives to improve physical characteristics, such as clays like kaolins, serpentines, attapulgites and the like also may be used.

Preferably, the carbonaceous fuel element is provided with one or more longitudinally extending passageways. These passageways help to control transfer of heat from the fuel element to the aerosol generating means, which is important both in terms of transferring enough heat to produce sufficient aerosol and in terms of avoiding the transfer of so much heat that the aerosol former is degraded. Generally, these passageways provide porosity and increase early heat transfer to the substrate by increasing the amount of hot gases which reach the substrate. They also tend to increase the rate of burning.

Generally, a large number of passageways, e.g., about 5 to 9 or more, especially with relatively wide spacings between the passageways produce high convective heat transfer, which leads to high aerosol delivery. A large number of passageways also generally helps assure ease of lighting.

High convective heat transfer tends to produce a higher CO output in the mainstream. To reduce CO levels, fewer passageways or a higher density fuel element may be employed, but such changes generally tend to make the fuel element more difficult to ignite, and to decrease the convective heat transfer, thereby lowering the aerosol delivery rate and amount. However, it has been discovered that with passageway arrangements which are closely spaced, as in FIG. 3C, such that they burn out or coalesce to form one passageway, at least at the lighting end, the amount of CO in the combustion products is generally lower in the same, but widely spaced, passageway arrangement. Another preferred passageway arrangement is the configuration of FIG. 2B, which has been found to be particularly advantageous for low CO delivery and ease of lighting.

The aerosol generating means used in practicing this invention is physically separate from the fuel element. By physically separate it is meant that the substrate, container, or chamber which contains the aerosol forming materials is not mixed with, or a part of, the fuel element. This arrangement helps reduce or eliminate thermal degradation of the aerosol forming substance and the presence of sidestream smoke. While not a part of the fuel element, the aerosol generating means preferably abuts, is connected to, or is otherwise adjacent to the fuel element so that the fuel and the aerosol generating means are in a conductive heat exchange relationship. Preferably, the conductive heat exchange relationship is achieved by providing a heat conductive member, such as a metal foil, recessed from the lighting end of the fuel element, which efficiently conducts or transfers heat from the burning fuel element to the aerosol generating means.

The aerosol generating means is preferably spaced no more than 15 to 20 mm from the lighting end of the fuel element. The aerosol generating means may vary in length from about 2 mm to about 60 mm, preferably from about 5 mm to 40 mm, and most preferably from about 20 mm to 35 mm. The diameter of the aerosol generating means may vary from about 2 mm to about 8 mm, preferably from about 3 to 6 mm.

Preferably, the aerosol generating means includes one or more thermally stable materials which carry one or more aerosol forming substances. As used herein, a "thermally stable" material is one capable of withstanding the high, albeit controlled, temperatures, e.g., from about 4OO° C. to about 6OO° C., which may eventually exist near the fuel, without significant decomposition or burning. The use of such material is believed to help maintain the simple "smoke" chemistry of the aerosol, as evidenced by a lack of Ames test activity in the preferred embodiments. While not preferred, other aerosol generating means, such as heat rupturable microcapsules, or solid aerosol formlng substances, are within the scope of this invention, provided they are capable of releasing sufficient aerosol forming vapors to satisfactorily resemble tobacco smoke.

Thermally stable materials which may be used as the carrier or substrate for the aerosol forming substance are well known to those skilled in the art. Useful carriers should be porous, and must be capable of retaining an aerosol forming compound and releasing a potential aerosol forming vapor upon heating by the fuel. Useful thermally stable materials include adsorbent carbons, such as porous grade carbons, graphite, activated, or non-activated carbons, and the like, such as PC-25 and PG-60 available from Union Carbide Corp., Danbury, CT, as well as SGL carbon, available from Calgon. Other suitable materials include inorganic solids, such as ceramics, glass, alumina, vermiculite, clays such as bentonite, and the like. Carbon and alumina substrates are preferred.

An especially useful alumina substrate is available from the Davison Chemical Division of W.R. Grace & Co. under the designation SMR-14-1896. Before use, this alumina is sintered at elevated temperatures, e.g., greater than 1OOO° C., washed, and dried.

It has been found that suitable particulate substrates also may be formed from carbon, tobacco, or mixtures of carbon and tobacco, into densified particles in a one-step process using a machine made by Fuji Paudal KK of Japan, and sold under the trade name of "Marumerizer." This apparatus is described in German Pat. No. 1,294,351 and U.S. Pat. No. 3,277,520 (now reissued as U.S. Pat. No. 27,214) as well as Japanese published specification No. 8684/1967.

The aerosol forming substance or substances used in the articles of the present invention must be capable of forming an aerosol at the temperatures present in the aerosol generating means upon heating by the burning fuel element. Such substances preferably will be composed of carbon, hydrogen and oxygen, but they may include other materials. Such substances can be in solid, semisolid, or liquid form. The boiling or sublimation point of the substance and/or the mixture of substances can range up to about 5OO° C. Substances having these characteristics include: polyhydric alcohols, such as glycerin, triethylene glycol, and propylene glycol, as well as aliphatic esters of mono-, di-, or poly-carboxylic acids, such as methyl stearate, dodecandioate, dimethyl tetradodecandioate, and others.

The preferred aerosol forming substances are polyhydric alcohols, or mixtures of polyhydric alcohols. More preferred aerosol formers are selected from glycerin, triethylene glycol and propylene glycol.

When a substrate material is employed as a carrier, the aerosol forming substance may be dispersed on or within the substrate in a concentration sufficient to permeate or coat the material, by any known technique. For example, the aerosol forming substance may be applied full strength or in a dilute solution by dipping, spraying, vapor deposition, or similar techniques. Solid aerosol forming components may be admixed with the substrate material and distributed evenly throughout prior to formation of the final substrate.

While the loading of the aerosol forming substance will vary from carrier to carrier and from aerosol forming substance to aerosol forming substance, the amount of liquid aerosol forming substances may generally vary from about 20 mg to about 120 mg, preferably from about 35 mg to about 85 mg, and most preferably from about 45 mg to about 65 mg. As much as possible of the aerosol former carried on the substrate should be delivered to the user as WTPM. Preferably, above about 2 weight percent, more preferably above about 15 weight percent, and most preferably above about 20 weight percent of the aerosol former carried on the substrate is delivered to the user as WTPM.

The aerosol generating means also may include one or more volatile flavoring agents, such as menthol, vanillin, artificial coffee, tobacco extracts, nicotine, caffeine, liquors, and other agents which impart flavor to the aerosol. It also may include any other desirable volatile solid or liquid materials. Alternatively, these optional agents may be placed between the aerosol generating means and the mouth end, such as in a separate substrate or chamber or coated within the passageway leading to the mouth end, in the tobacco jacket, or in any other tobacco charges.

One particularly preferred aerosol generating means comprises the aforesaid alumina substrate containing spray dried tobacco extract, tobacco flavor modifiers, such as levulinic acid, one or more flavoring materials, and an aerosol forming material, such as glycerin. In certain preferred embodiments, this substrate may be mixed with densified tobacco particles, such as those produced on a "Marumerizer", which particles may also be impregnated with an aerosol forming material.

Articles of the type disclosed herein may be used or may be modified for use as drug delivery articles, for delivery of volatile pharmacologically or physiologically active materials such as ephedrine, metaproterenol, terbutaline, or the like.

As shown in the illustrated embodiments, the aerosol generating means, or at least a portion thereof, is circumscribed by a mass of tobacco containing material through which gases and vapors, and optionally the aerosol forming material may pass during smoking of the article. This tobacco mass also may circumscribe all or a part of the fuel element. During smoking, hot vapors are swept through the tobacco to extract and distill the volatile components from the tobacco, without combustion or substantial pyrolysis. Thus, the user receives an aerosol which contains the tastes and flavors of natural tobacco without the numerous combustion products produced by a conventional cigarette.

The tobacco containing material employed around the aerosol generating means may contain any tobacco available to the skilled artisan, such as Burley, Flue Cured, Turkish, reconstituted tobacco, extruded tobacco mixtures, tobacco containing sheets, and the like. Advantageously, a blend of tobaccos may be used to contribute a greater variety of flavors. The tobacco containing material may also include conventional tobacco additives, such as fillers, casings, reinforcing agents, humectants, and the like. Flavor agents may likewise be added to the tobacco jacket, as well as flavor modifying agents.

The tobacco containing material may also include mixtures of tobacco and glass fibers, which may be in sheet, strip, or tube form. Tobacco sheets containing glass fibers may be prepared using standard paper making techniques. A preferred flocculating agent is Separan, available from Dow, which is used according to manufacturer's specifications. A preferred surface modifying agent is Katapol, available from GAF, which is used according to manufacturer's specifications. A preferred glass fiber is Manniglas 1000, available from the Manning Paper Company.

Generally glass fibers in the range of from about 30 weight percent to about 70 weight percent, preferably about 50 weight percent, are useful in the articles of the present invention.

The paper-like sheet comprising an admixture of tobacco solids and glass fibers may be cut into strips, treated with conventional cigarette casing materials and/or tobacco dust to improve the color and flavor characteristics, and cut into tobacco like shreds. Using conventional cigarette making equipment, this shredded material may be formed into cigarette shaped rods and overwrapped with cigarette paper.

Preferred embodiments of the inventions normally do not employ tobacco around the fuel element in order to avoid the production of tobacco pyrolysis and degradation products and their incorporation into the aerosol delivered to the user. However, as shown in FIGS. 1 and 2, tobacco may be employed around the fuel element to provide the user with both the aroma of burning tobacco during use, as well as significant tobacco flavor in the mainstream aerosol. In embodiments of this type, the tobacco is preferably consumed only to the extent that the fuel element is consumed, i.e., up to about the point of contact between the fuel element and the aerosol generating means. This may be achieved by compressing the tobacco around the fuel element and employing a heat conducting member between the tobacco jacket and the rear portion of the fuel element and/or the aerosol forming material. It also may be achieved by treating the cigarette paper overwrap and/or the tobacco with materials which help extinguish the tobacco at the point were it overlaps the aerosol generating means.

The heat conducting material preferably employed in constructing the preferred container for the aerosol generating means and/or the heat conducting member is typically a metallic tube, strip, or foil, such as aluminum, varying in thickness from less than about 0.01 mm to about 0.2 mm, or more. The thickness and/or the type of conducting material may be varied (e.g., other metals or Grafoil, from Union Carbide) to achieve virtually any desired degree of heat transfer. As shown in the illustrated embodiments, the heat conducting material preferably contacts or overlaps the rear portion of the fuel element, and forms the container which encloses the aerosol forming substance. However, more than one member or material may be employed to perform these functions.

Preferably, the heat conducting member extends over no more than about one-half the length of the fuel element. More preferably, the heat conducting member overlaps or otherwise contacts no more than about the rear 5 mm of the fuel element. Preferred recessed members of this type do not interfere with the lighting or burning characteristics of the fuel element. Such members help to extinguish the fuel element and its optional peripheral tobacco jacket when the fuel element has been consumed to the point of contact with the conducting member by acting as a heat sink. These members also do not protrude from the lighting end of the article even after the fuel element has been consumed.

If the preferred heat conductive container is employed it may be provided with passages adjacent the tobacco jacket to permit gases and vapors to flow through the bed of tobacco. These passages also may be used to help control the pressure drop through the article. As illustrated in FIG. 3, the heat conductive container also may be crimped or shaped to help control the pressure drop, or to provide other desirable effects.

The fuel element insulating members employed in practicing the invention are preferably formed into a resilient jacket from one or more layers of an insulating material. Advantageously, this jacket is at least about 0.5 mm thick, preferably at least about 1 mm thick, more preferably between about 1.5 to 2 mm thick. Preferably, the jacket extends over more than about half, if not all of the length of the fuel element.

Insulating members which may be used in accordance with the present invention generally comprise inorganic or organic fibers such as those made out of glass, alumina, silica, vitreous materials, mineral wool, carbons, silicons, boron, organic polymers, and the like, including mixtures of these materials. Nonfibrous insulating materials, such as silica aerogel, pearlite, glass, and the like may also be used. Preferred insulating members are resilient, to help simulate the feel of a conventional cigarette. These materials act primarily as an insulating jacket, retaining and directing a significant portion of the heat formed by the burning fuel element to the aerosol generating means. Because the insulating jacket becomes hot adjacent to the burning fuel element, to a limited extent, it also may conduct heat toward the aerosol generating means.

The currently preferred insulating fibers are ceramic fibers, such as glass fibers. Two suitable glass fibers are available from the Manning Paper Company of Troy, New York, under the designations, Manniglas 1000 and Manniglas 1200. When possible, glass fiber materials having a low softening point, e.g., below about 650° C., are preferred. The preferred glass fibers include experimental materials produced by Owens—Corning of Toledo, Ohio under the designations 6432 and 6437.

Several commercially available inorganic insulating fibers are prepared with a binder e.g., PVA, which acts to maintain structural integrity during handling. These binders, which would exhibit a harsh aroma upon heating, should be removed, e.g., by heating in air at about 650° C. for up to about 15 min. before use herein. If desired, pectin, at up to about 3 wt. percent may be added to the fibers to provide mechanical strength to the jacket without contributing harsh aromas.

In most embodiments of the invention, the fuel and aerosol generating means will be attached to a mouthend piece, although a mouthend piece may be provided separately, e.g., in the form of a cigarette holder. This element of the article provides the enclosure which channels the vaporized aerosol forming substance into the mouth of the user. Due to its length, about 35 to 50 mm, it also keeps the hot fire cone away from the mouth and fingers of the user, and provides sufficient time for the hot aerosol to cool before reaching the user.

Suitable mouthend pieces should be inert with respect to the aerosol forming substances, should have a water or liquid proof inner layer, should offer minimum aerosol loss by condensation or filtration, and should be capable of withstanding the temperature at the interface with the other elements of the article. Preferred mouthend pieces include a cellulose acetate tube, optionally containing a plastic inner tube as illustrated in FIGS. 1–3, in which the cellulose acetate tube acts as a resilient outer member to help simulate the feel of a conventional cigarette in the mouth end portion of the article. Other suitable mouthend pieces will be apparent to those of ordinary skill in the art.

The mouthend pieces of the invention may include an optional "filter" tip, which is used to give the article the appearance of the conventional filtered cigarette. Such filters include low efficiency cellulose acetate filters and hollow or baffled plastic filters, such as those made of polypropylene. Such filters do not appreciably interfere with the aerosol delivery.

The entire length of the article, or any portion thereof, may be overwrapped with one or more layers of cigarette paper. Preferred papers at the fuel element end should not openly flame during burning of the fuel element. In addition, the paper should have controllable smolder properties and should produce a grey, cigarette-like ash.

In those embodiments utilizing an insulating jacket wherein the paper burns away from the jacketed fuel element, maximum heat transfer is achieved because air flow to the fuel element is not restricted. However, papers can be designed or engineered to remain wholly or partially intact upon exposure to heat from the burning fuel element. Such papers provide the opportunity to restrict air flow to the burning fuel element, thereby controlling the temperature at which the fuel element burns and the subsequent heat transfer to the aerosol generating means.

To reduce the burning rate and temperature of the fuel element, thereby maintaining a low $CO/CO_2$ ratio, a non-porous or zero-porosity paper treated to be slightly porous, e.g., non-combustible mica paper with a plurality of holes therein, may be employed as the overwrap layer. Such a paper controls heat delivery, especially in the middle puffs (i.e., 4–6).

To maximize aerosol delivery, which otherwise would be diluted by radial (i.e., outside) air infiltration through the article, a non-porous paper may be used from the aerosol generating means to the mouth end.

Papers such as these are known in the cigarette and/or paper arts and mixtures of such papers may be employed for various functional effects. Preferred papers used in the articles of the present invention include ECUSTA 01788 and 646 plug wrap manufactured by Ecusta of Pisgah Forest, NC, and Kimberly-Clark's KC-63-5, P 878-5, P 878-16-2, and 780-63-5 papers.

The aerosol produced by the preferred articles of the present invention is chemically simple, consisting essentially of air, water, oxides of carbon, the aerosol former, any desired flavors or other desired volatile materials, and trace amounts of other materials. The WTPM produced by the preferred articles of this invention has no measurable mutagenic activity as measured by the Ames test, i.e., there is no significant dose response relationship between the WTPM produced by preferred articles of the present invention and the number of revertants occurring in standard test microorganisms exposed to such products. According to the proponents of the Ames test, a significant dose dependent response indicates the presence of mutagenic materials in the products tested. See Ames et al., *Mut. Res.*, 31:347–364 (1975); Nagas et al., *Mut. Res.*, 42:335 (1977).

A further benefit from the preferred embodiments of the present invention is the relative lack of ash produced during use in comparison to ash from a conventional cigarette. As the preferred carbon fuel element is burned, it is essentially converted to oxides of carbon, with relatively little ash generation, and thus there is no need to dispose of ashes while using the article.

The smoking article of the present invention will be further illustrated with reference to the following examples which aid in the understanding of the present invention, but which are not to be construed as limitations thereof. All percentages reported herein, unless otherwise specified, are percent by weight. All temperatures are expressed in degrees Celsius and are uncorrected. In all instances, the articles have a diameter of about 7 to 8 mm, the diameter of a conventional cigarette.

EXAMPLE 1

Smoking articles of the type substantially as illustrated in FIG. 3 were made from an extruded carbon fuel element in the following manner.

The fuel element (10 mm long, 4.5 mm o.d.) having an apparent (bulk) density of about 0.86 g/cc, was prepared with 10 wt. percent spray dried flue cured tobacco extract (preparation described below) in addition to carbon, SCMC binder (10 wt. percent) and $K_2CO_3$ (1 wt. percent). The carbon was prepared from Grand Prairie Canadian Kraft Paper made from hardwood and obtained from Buckeye Cellulose Corp., Memphis, TN, using a gradually increasing carbonizing temperature of about 5° C. per hour in a non-oxidizing atmosphere, to a maximum carbonizing temperature of 750° C. After cooling, the carbon was ground to a mesh size of minus 200. The powdered carbon was then heated to a temperature of 650° C. to 750° C. to remove volatiles. The fuel element was extruded with seven holes (each about 0.6 mm diameter) in a closely spaced arrangement (similar to FIG. 3C) with a core diameter (i,e., the diameter of the smallest circle which will circumscribe the holes in the fuel element) of about 2.6 mm and spacing between the holes of about 0.3 mm.

The macrocapsule was prepared from drawn aluminum tubing, about 30 mm in length, having an outer diameter of about 4.5 mm. The rear 2 mm of the capsule was crimped to seal the mouth end of the capsule. At the mouth end, four equally spaced grooves were indented in the side of the capsule, each to a depth of about 0.75 mm to afford a "rib-shaped" capsule similar to that illustrated in FIG. 3A. This was accomplished by inserting the capsule into a die having four equally spaced wheels of about 0.75 mm depth located such that the rear 18 mm of the capsule was grooved to afford four equally spaced channels. Four holes (each about 0.72 mm diameter) were made in the capsule at the transition between the ungrooved portion of the capsule and each of the grooves (as shown in FIGS. 3 and 3A). In addition, a central hole (d=about 0.72 mm) was made in the sealed end of the capsule, approximately 17 mm from the holes at the fuel end of the grooves.

The tobacco extract used in this example was prepared as follows. Tobacco was ground to a medium dust and extracted with water in a stainless steel tank at a concentration of from about 1 to 1.5 pounds tobacco per gallon water. The extraction was conducted at ambient temperature using mechanical agitation for from about 1 hour to about 3 hours. The admixture was centrifuged to remove suspended solids and the aqueous extract was spray dried by continuously pumping the aqueous solution to a conventional spray dryer, such as an Anhydro Size No. 1, at an inlet temperature of from about 215°-230° C. and collecting the dried powder material at the outlet of the drier. The outlet temperature varied from about 82°-9O° C.

High surface area alumina (surface area=280 $m^2/g$) from W.R. Grace & Co. (designated SMR-14-1896), having a mesh size of from −8 to +14 (U.S.) was sintered at a soak temperature above about 14OO° C., preferably from about 1400° to 1550° C., for about one hour and cooled. The alumina was washed with water and dried. The alumina (640 mg) was treated with an aqueous solution containing 107 mg of spray dried flue cured tobacco extract and dried to a moisture content of from about 1 to 5, preferably about 3.5, weight percent. This material was then treated with a mixture of 233 mg of glycerin and 17 mg of a flavor component obtained from Firmenich, Geneva, Switzerland, under the designation T69-22 (or an equivalent). The capsule was filled with a 1:1 mixture of the treated alumina and densified (i.e., Marumerized) flue cured tobacco having a density of about 0.8 g/cc and loaded with about 15 wt. percent glycerin.

The fuel element was inserted into the open end of the filled macrocapsule to a depth of about 3 mm. The fuel element—macrocapsule combination was overwrapped at the fuel element end with a 10 mm long, glass fiber jacket of Owens-Corning 6437 (having a softening point of about 640° C.), with 3 wt. percent pectin binder, to a diameter of about 8 mm and overwrapped with Ecusta 646 plug wrap.

An 8 mm diameter tobacco rod (28 mm long) with an Ecusta 646 plug wrap overwrap was modified to have a longitudinal passageway (about 4.5 mm diameter) therein. The jacketed fuel element—macrocapsule combination was inserted into the tobacco rod passageway until the glass fiber jacket abutted the tobacco jacket. The glass fiber and tobacco sections were overwrapped with Kimberly-Clark P 878-16-2 paper.

A cellulose acetate mouthend piece (30 mm long) overwrapped with Ecusta 646 plug wrap and containing a 28 mm long polypropylene tube, recessed 2 mm from the fuel element end (as illustrated in FIG. 3) was joined to a filter element (10 mm long) having an overwrap of Ecusta 646 plug wrap, by P878-16-2 paper. This mouthend piece section was joined to the jacketed fuel element—macrocapsule section by tipping paper.

During use, heated air and gases enter the tobacco jacket through the glass fiber jacket and through the holes in the capsule. A portion of the aerosol forming material also enters the tobacco jacket through the holes in the capsule.

Alternatively, the embodiment described herein may be modified to incorporate one or more of the following changes: (a) levulinic acid, at about 0.7 weight percent, may be added to the substrate; (b) the capsule need not contain Marumerized tobacco; (c) the flavor material(s) may be added to the tobacco jacket; (d) the capsule need not contain any tobacco flavor material(s); and (e) the shape of the capsule may be modified, e.g., the mouthend portion may be rectangular in lieu of lobe shaped, or the capsule may be a tube with a crimped mouthend, with or without the peripheral passageways.

EXAMPLE 2

Smoking articles substantially as illustrated in FIG. 2 were prepared as follows:

The fuel element (7 mm long, 5.2 mm o.d.) was prepared in a manner similar to that described in Example 1, but 12 holes (each about 0.6 mm diameter) were drilled near the peripheral edge (see FIG. 2A).

The macrocapsule was prepared from the aluminum tubing of Example 1, i.e., 4.5 mm outer diameter drawn aluminum, about 30 mm in length. This tubing was sealed by crimping one end. The sealed capsule (27 mm in length) was drawn so that about 23 mm of the sealed, i.e., mouth end, portion of the capsule, was reduced in diameter to about 4 mm. A portion (about 3 mm) of the open end of the capsule was expanded in diameter to about 5.1 mm. A die/pin arrangement having a small diameter (4 mm) for about 23 mm and a wide diameter (5 mm) for about 3 mm enabled the rapid production of the capsules. Two slits (about 13 mm long) were cut into the mouth end of the capsule, beginning about 7 mm from the fuel element end of the capsule. The cuts were made tangentially such that the openings flared out from the side of the capsule about 1 mm and such that the substrate did not fall out.

This capsule was filled with about 170 mg of the alumina substrate of Example 1. This substrate consisted of about 68 weight percent alumina, 11.3 weight percent spray dried flue cured tobacco extract (prepared as in Example 1), 18.1 weight percent glycerin, 0.7 weight percent levulinic acid, and 1.9 weight percent T69–22 flavor. The fuel element was inserted into the open end of the capsule, to a depth of about 2.5 mm.

A tobacco rod, about 32 mm in length, (e.g., from a non-filtered cigarette) was modified with a stepped probe to compact the tobacco and form a longitudinal passageway of about 5.6 mm diameter (for about 10 mm) and about 4.3 mm diameter (for about 22 mm). This tobacco rod was connected by a paper wrap to a cellulose acetate mouthend piece (30 mm) having a conventional filter element (10 mm).

The fuel element/capsule combination was inserted into the passageway in the tobacco rod and the article was overwrapped with one or more cigarette papers.

EXAMPLE 3

Smoking articles substantially as illustrated in FIG. 1 were prepared as follows.

The fuel element (7 mm long, 5 mm o.d.) was prepared in a manner similar to that described in Example 1, but 12 holes (each about 0.5 mm diameter) were drilled near the peripheral edge and a central passageway of from about 1 to 2 mm in diameter was drilled through the fuel element using a No. 44 drill bit, as shown in FIG. 1B.

The macrocapsule was prepared from the aluminum tubing of Example 1, i.e., 4.5 mm outer diameter drawn aluminum, about 30 mm in length. This tubing was drawn down for about 3 mm at one end to a diameter of about 2 mm. This drawn end of the capsule was cut to about a 2 mm length, leaving the passageway open into the capsule.

Beyond the 2 mm drawn end, the capsule retained the original 4.5 mm diameter with a length of about 22 mm. The mouth end of the capsule was sealed by crimping about 2 mm of the aluminum together. A series of three holes were created in the capsule about 1 mm behind the shoulder formed by the size change from the fuel end of the capsule to the mouth end, using a 26 gauge syringe needle. An additional hole was created in the sealed end of the capsule using the same needle. This capsule was filled with about 200 mg of PG-60 granulated graphite substrate bearing about 28 weight percent glycerin.

The 2 mm drawn end of the capsule was inserted into the rear of the central passageway of the fuel element up to the point where the elements abutted. This combination of drawn capsule and fuel element was used as a "core element" having a length of about 27 mm.

A 27 mm long tobacco rod with a cigarette paper wrap (e.g., from a non-filtered cigarette) was modified with a probe to compress the tobacco and to provide a 4.5 mm central passage and a Mylar tube (about 4.5 mm diameter) was placed in the passage to keep the tobacco in place.

The core element was inserted into the tobacco rod causing the Mylar tube to exit at the mouth end. A cellulose acetate tube, having attached thereto a filter element, as utilized in Example 1, was abutted against the tobacco rod and the elements were connected with a section of cigarette paper.

At the location of the shoulder of the capsule, a band of sodium silicate was placed on the cigarette paper wrap to prevent the burning of the tobacco jacket by heat from the fuel element.

The article was overwrapped with one or more cigarette papers.

Articles of this type delivered an average of about 24 mg WTPM, and about 13.5 mg CO when measured over ten puffs at a puff frequency of 30 seconds, a puff duration of 2 seconds, and a puff volume of 50 ml.

EXAMPLE 4

Smoking articles of the type described in the preceding examples having a tobacco jacket containing glass fibers were prepared as follows:

Glass Fiber Suspension:

Katapol (0.02 g), Separan (0.08 g) and water (16 oz., 473 ml) were admixed in a laboratory blender for about 20 seconds. Pieces of glass fiber sheets (0.758 g) were added to the liquid and mixed at high speed for several minutes. This procedure was repeated until a total volume of one gallon was obtained.

Suspension Liquid:

Following the procedure set forth above, water and Separan were admixed (473 ml water/0.156 g Separan). Sufficient repetitions of this procedure were conducted to afford about 2 gallons of suspension liquid.

Tobacco Hand Sheet:

Ground tobacco particles, extracts, stems, and other solid components, were suspended in water at a concentration of about 0.5 g/ml. This tobacco suspension was used to make a tobacco control sheet following standard paper making techniques. The tobacco suspension was placed in the paper making head box, agitated, and the solution was removed. The hand sheet was then pressed to remove excess water and dried.

Tobacco/Glass Fiber Hand Sheet:

Following the procedure set forth above for preparing a tobacco hand sheet, tobacco suspension (2.5 oz) and glass fiber suspension (32 oz) were admixed in a laboratory blender at high speed for about one minute. Suspension liquid (supra, 500 ml) was added to the hand sheet preparation equipment, then the tobacco/glass fiber admixture was added. Treatment of the tobacco/glass fiber admixture in a manner similar to that used to prepare the tobacco control sheet afforded a tobacco/-glass fiber paper-like sheet.

Tobacco Glass Fiber Jacket:

The paper-like hand sheet comprising an admixture of tobacco solids and glass fibers was cut into strips, treated with conventional cigarette casing materials and tobacco dust to improve the color and flavor characteristics, and cut into tobacco-like shreds. Using conventional cigarette making equipment, this shredded material was used to make cigarette rods, overwrapped with cigarette paper, which were used to make smoking articles of the present invention.

EXAMPLE 5

Several smoking articles of the present invention were prepared and smoked under FTC smoking conditions. The collected WTPM from these articles was then tested in the Ames assay as described below with no evidence of mutagenicity.

Example 5A consisted of a fuel element having nine holes arranged substantially as illustrated in FIG. 1A. This fuel element was prepared in a manner similar to the method of Example 1. The capsule was prepared substantially as in Example 1, but contained 290 mg of a mixture of PG-60 granulated graphite, spray dried flue cured tobacco, and glycerin. The tobacco jacket was a conventional non-filtered cigarette (27 mm). A 10 mm cellulose acetate filter piece was butted against the cellulose acetate/polypropylene tube mouthend piece and the article was overwrapped with cigarette paper and KC 780-63-5 paper.

Smoking five articles of this type for 8 puffs under FTC conditions afforded the following WTPM data:

| Example | WTPM |
|---|---|
| A1 | 12.4 mg |
| A2 | 12.6 mg |
| A3 | 8.9 mg |
| A4 | 12.0 mg |
| A5 | 10.7 mg |

For a total WTPM of 56.6 mg and an average WTPM of 11.3 mg per 8 puffs.

Example 5B was a repeat of Example 5A, except that the cellulose acetate filter piece was removed prior to smoking. These articles afforded the following WTPM data under FTC smoking conditions:

| Example | Puffs | WTPM |
|---|---|---|
| B1 | 8 | 12.6 mg |
| B2 | 8 | 13.3 mg |
| B3 | 9 | 11.8 mg |
| B4 | 7 | 11.4 mg |

For a total WTPM of 49.1 mg and an average of 12.3 mg per 8 puffs.

The filter pad for each of the above examples containing the total collected WTPM was shaken for 30 minutes in DMSO to dissolve the WTPM. Each sample was then diluted to a concentration of 1 mg/ml and used "as is" in the Ames assay. Using the procedure of Nagas et al., Mut. Res., 42:335–342 (1977), 1 mg/ml concentrations of WTPM were admixed with the S-9 activating system, plus the standard Ames bacterial cells, and incubated at 37° C. for twenty minutes. The bacterial strains used in this Ames assay were *Salmonella typhimurium*, TA 98 and TA 100. See Purchase et al., *Nature*, 264:624–627 (1976). Agar was then added to the mixture, and plates were prepared. The agar plates were incubated for two days at 37° C., and the resulting cultures were counted. Four plates were run for each dilution and the results of the colonies were compared against a pure DMSO control culture. As shown in Table I, there was no mutagenic activity caused by the WTPM obtained from any of the smoking articles tested. This can be ascertained by comparison of the mean number of revertants per plate with the mean number of revertants obtained from the control (0 ug WTPM/Plate). For mutagenic samples, the mean number of revertants per plate will increase significantly with increasing doses.

TABLE I

| | Dose (ug WTPM/Plate) | Mean Revertants/Plate TA 98 | TA 100 |
|---|---|---|---|
| | | EXAMPLE 5A | |
| Control | 0 | 47.0 ± 6.1 | 133.0 ± 4.8 |
| | 50 | 52.0 ± 5.5 | 139.3 ± 25.4 |
| | 100 | 54.3 ± 16.9 | 136.8 ± 12.6 |
| | 150 | 51.0 ± 6.7 | 140.5 ± 14.0 |
| | 200 | 55.5 ± 5.9 | 128.9 ± 13.3 |
| | 300 | 63.5 ± 8.5 | 128.3 ± 17.2 |
| | 400 | 67.8 ± 7.9 | 145.0 ± 8.0 |
| | | EXAMPLE 5B | |
| Control | 0 | 52.0 ± 10.8 | 137.5 ± 10.2 |
| | 50 | 49.3 ± 6.9 | 128.5 ± 7.0 |
| | 100 | 54.0 ± 5.4 | 137.5 ± 10.5 |
| | 150 | 55.5 ± 9.0 | 131.0 ± 13.8 |
| | 200 | 56.8 ± 9.6 | 138.3 ± 9.7 |
| | 300 | 56.3 ± 7.3 | 131.0 ± 2.9 |
| | 400 | 57.5 ± 7.8 | 133.3 ± 9.0 |

We claim:

1. A cigarette-type smoking article comprising:
(a) a carbonaceous fuel element;
(b) a physically separate aerosol generating means including an aerosol forming material located between the fuel element and the mouth end of the article; and
(c) a physically separate tobacco containing mass which circumscribes at least a portion of the aerosol generating means.

2. The article of claim 1, wherein the fuel element and the aerosol generating means are in a conductive heat exchange relationship.

3. The article of claim 2, further comprising a heat conducting member which contacts both the fuel element and the aerosol generating means.

4. The article of claim 1, further comprising a heat conductive container which encloses at least a portion of the aerosol forming material.

5. The article of claim 4, wherein the container is provided with at least one passageway which permits gases and the aerosol forming material to pass into the tobacco containing mass.

6. The article of claim 1, further comprising an insulating member which circumscribes at least a portion of the fuel element.

7. The article of claim 6, wherein the insulating member is resilient and at least 0.5 mm thick.

8. The article of claim 1, further comprising a mouthend piece having an aerosol delivery passage and a resilient outer member.

9. The article of claim 1, 2, 3, 4, 5, 6, 7, or 8, wherein the tobacco containing mass circumscribes substantially the entire length of the aerosol generating means.

10. The article of claim 1, 2, 3, 4, 5, 6, 7, or 8, wherein the fuel element is less than about 30 mm in length.

11. The article of claim 10, wherein the fuel element has a plurality of longitudinal passageways.

12. The article of claim 1, 2, 3, 4, 5, 6, 7, or 8, wherein the fuel element is less than about 20 mm in length.

13. The article of claim 12, wherein the fuel element has a plurality of longitudinal passageways.

14. A cigarette-type smoking article comprising:
(a) a combustible fuel element less than about 30 mm in length;

(b) a physically separate aerosol generating means including an aerosol formong material located between the fuel element and the mouth end of the article; and (c) a physically separate tobacco containing mass which circumscribes at least a portion of the aerosol generating means.

15. The article of claim 14, wherein the fuel element and the aerosol generating means are in a conductive heat exchange relationship.

16. The article of claim 15, further comprising a heat conducting member which contacts both the fuel element and the aerosol generating means.

17. The article of claim 14, further comprising a heat conductive container which encloses at least a portion of the aerosol forming material.

18. The article of claim 17, wherein the container is provided with at least one passageway which permits gases and the aerosol forming material to pass into the tobacco containing mass.

19. The article of claim 14, further comprising an insulating member which circumscribes at least a portion of the fuel element.

20. The article of claim 19, wherein the insulating member is resilient and at least 0.5 mm thick.

21. The article of claim 14, further comprising a mouthend piece having an aerosol delivery passage and a resilient outer member.

22. The article of claim 14, wherein the fuel element contains carbon.

23. The article of claim 14, 15, 16, 17, 18, 19, 20, or 21, wherein the fuel element is less than about 30 mm in length.

24. The article of claim 23, wherein the fuel element contains carbon.

25. The article of claim 23, whereln the fuel element has a plurality of longitudinal passageways.

26. The article of claim 14, 15, 16, 17, 18, 19, 20, or 21, wherein the fuel element is less than about 20 mm in length.

27. The article of claim 26, wherein the fuel element contains carbon.

28. The article of claim 26, wherein the fuel element has a plurality of longitudinal passageways.

29. The article of claim 14, 15, 16, 17, 18, 19, 20, or 21, wherein the tobacco containing mass circumscribes substantially the entire length of the aerosol generating means.

30. The article of claim 1, 3, 5, 14, 16, or 18, which delivers at least about 0.6 mg of wet total particulate matter in the first three puffs under FTC smoking conditions.

31. The article of claim 1, 3, 5, 14, 16, or 18, which delivers an average of at least about 0.8 mg of wet total particulate matter per puff for at least six puffs under FTC smoking conditions.

32. The article of claim 1, 5, 14, or 18, in which tobacco circumscribes the fuel element and the aerosol generating means and wherein the tobacco around the aerosol generating means does not burn during use.

33. The article of claim 1, or 5, having no mutagenic activity in the wet total particulate matter, as measured by the Ames test.

* * * * *